United States Patent [19]

Fisher et al.

[11] 4,043,393

[45] Aug. 23, 1977

[54] EXTRACTION FROM UNDERGROUND COAL DEPOSITS

[76] Inventors: Sidney T. Fisher, 53 Morrison Ave.; Charles B. Fisher, 2850 Hill Park Road, both of Montreal, Quebec, Canada

[21] Appl. No.: 709,832

[22] Filed: July 29, 1976

[51] Int. Cl.[2] ..... E21B 43/24; E21B 43/25

[52] U.S. Cl. ..... 166/248; 166/256; 166/267; 166/302; 166/303

[58] Field of Search ..... 166/248, 256, 259, 267, 166/302, 303, 50, 57, 60; 299/2, 14; 219/10.41, 10.57, 10.75, 10.79, 277, 278; 48/DIG. 6

[56] References Cited

U.S. PATENT DOCUMENTS

| | | | |
|---|---|---|---|
| 2,472,445 | 6/1949 | Sprong | 166/60 |
| 2,634,961 | 4/1953 | Ljungstrom | 166/302 |
| 2,856,292 | 10/1958 | Mann et al. | 219/10.41 X |
| 2,859,952 | 11/1958 | Tour et al. | 299/14 |
| 2,923,535 | 2/1960 | Ljungstrom | 166/256 |
| 2,939,689 | 6/1960 | Ljungstrom | 166/60 X |
| 3,379,248 | 4/1968 | Strange | 166/256 |
| 3,472,987 | 10/1969 | Viart | 219/10.41 |
| 3,548,938 | 12/1970 | Parker | 166/256 |
| 3,727,982 | 4/1973 | Itoh et al. | 299/14 |

*Primary Examiner*—Stephen J. Novosad
*Assistant Examiner*—George A. Suchfield
*Attorney, Agent, or Firm*—Barrigar & Oyen

[57] ABSTRACT

A method of extracting hydrocarbons, energy and other products in situ from an underground coal deposit. A selected part of the coal deposit is heated by electrical induction to temperatures high enough to effect the destructive distillation of coal. The gases and liquids so produced are collected. Next, air or oxygen is injected into the remaining deposit which consists primarily of coke in order to burn it in place. The hot combustion gases thereby yielded are led to the surface of the deposit to generate energy. Lastly, the heat remaining underground after the coke has been burned is extracted by injecting water or steam into the deposit. The resulting steam is conducted to the surface to drive a steam turbine. The electrical induction heating is conveniently effected by passing a selected time varying current through a conductive path encompassing that part of the coal deposit to be heated.

12 Claims, 14 Drawing Figures

FOR PLAN SEE FIG. 11

EXTRACTION FROM UNDERGROUND COAL DEPOSITS

FIELD TO WHICH THE INVENTION RELATES

The present invention relates to a method of destructive distillation in situ of an undergound coal deposit and the collection of the gases, liquids and energy thereby produced followed by the combustion of the coke. After the coke has been burned the heat remaining underground is removed by a heat exchange technique.

BACKGROUND OF THE INVENTION

Coal occurs in horizontal beds which in the case of bituminous coal are frequently of great extent. The beds vary in thickness from a foot or two to one hundred feet or more, and occur at varying depths. There are two principal methods for mining coal. Firstly, there is strip mining. In this method, the top soil is removed and the underlying coal deposit is collected. Strip mining generally causes severe environmental degradation in that the top soil is removed and covered, the surface and undersurface drainage of the land is seriously disturbed and strongly acidic compounds are commonly leached out of the material exposed after the overburden and coal are removed. Restoration of the land after strip mining is expensive and is seldom successful. Thus, strip mining is increasingly regarded as unacceptable because of the associated destruction of the environment.

The second method for collecting coal involves deep coal mining. Deep mining causes severe ecological degradation, principally due to the amount of rock brought up to the surface with the coal, and coal dust or other fumes. Such mining is costly, and requires a large amount of manual labour. Inevitably also, deep coal mining is accompanied by a high incidence of accidents, caused by rock falls and gas explosions. In addition, the coal dust in the mine atmosphere causes lung problems and it is well known that many coal miners are afflicted by a blacklung disease. Lastly, in deep mining only about half of the coal in a seam is extracted. In fact, most of the coal is not mined at all because the seams are either too thin or too deep to permit economic working.

The method described herein avoids all the foregoing disadvantages of conventional coal mining techniques.

SUMMARY OF THE INVENTION

The invention is a method of extracting and processing in situ an underground coal deposit to generate gases, liquids and energy which comprises the heating by electrical induction of a selected portion of the coal deposit to a temperature sufficient to effect the destructive distillation of that portion of the deposit and then collecting the gases and liquids so yielded.

Electrical induction heating will be effected by substantially encompassing the portion of the coal deposit to be processed with electrical conductors.

The literature reports that the resistivity of coal drops rapidly as the temperature of the coal increases. Assuming this to be the case, it is further proposed according to this invention that oxygen, air or some other suitable material be injected into the vertical drill holes which are located on the inner radius of the quasi-toroidal coil or into the central vertical shaft of the quasi-toroidal coil and ignited. The ensuing combustion quickly raises the temperature of a thin layer of coal at the central vertical shaft or at the drill holes and the resistivity of the coal decreases. A lower resistivity permits larger induction currents to flow at the drill holes or central shaft. The induction heating will spread from these areas to form a continuous cylindrical shell.

This invention for extracting gases, liquids and energy in situ from an underground coal deposit, using electrical induction heating, consists of the following stages:

1. As the temperature of the deposit increases to above 100° C, the coal begins to give off steam which is led to the surface and further heated there by a steam generator to be injected into the heated region of the deposit after the coke has been burned to remove heat from the underground region.

2. Gases and coal tar in gaseous form are generated by the coal as the temperature reaches the range of 450° C to 750° C. These gases are led to the surface where the tar and coal gas are separated.

3. After the gases and coal tar in gaseous form have been evolved, the residue of the deposit is primarily coke. The conductor elements of the induction coil are removed and air or oxygen is injected to burn the coke. Combustion occurs and the principal product, carbon dioxide, is educted to the surface to drive a gas turbine. The gas turbine exhaust feeds the steam generator mentioned in stage 1 above. The steam turbine and gas turbine may be mechanically coupled and employed to drive an AC generator used for the input to the inductor coil system.

4. Lastly, the heat remaining underground after combustion of the coke may be extracted by injecting low temperature steam into the heated underground portion. The steam is heated and may be led to the surface to drive a steam turbine.

DETAILED DESCRIPTION WITH REFERENCE TO THE DRAWINGS

Figures 1, 2, 3:
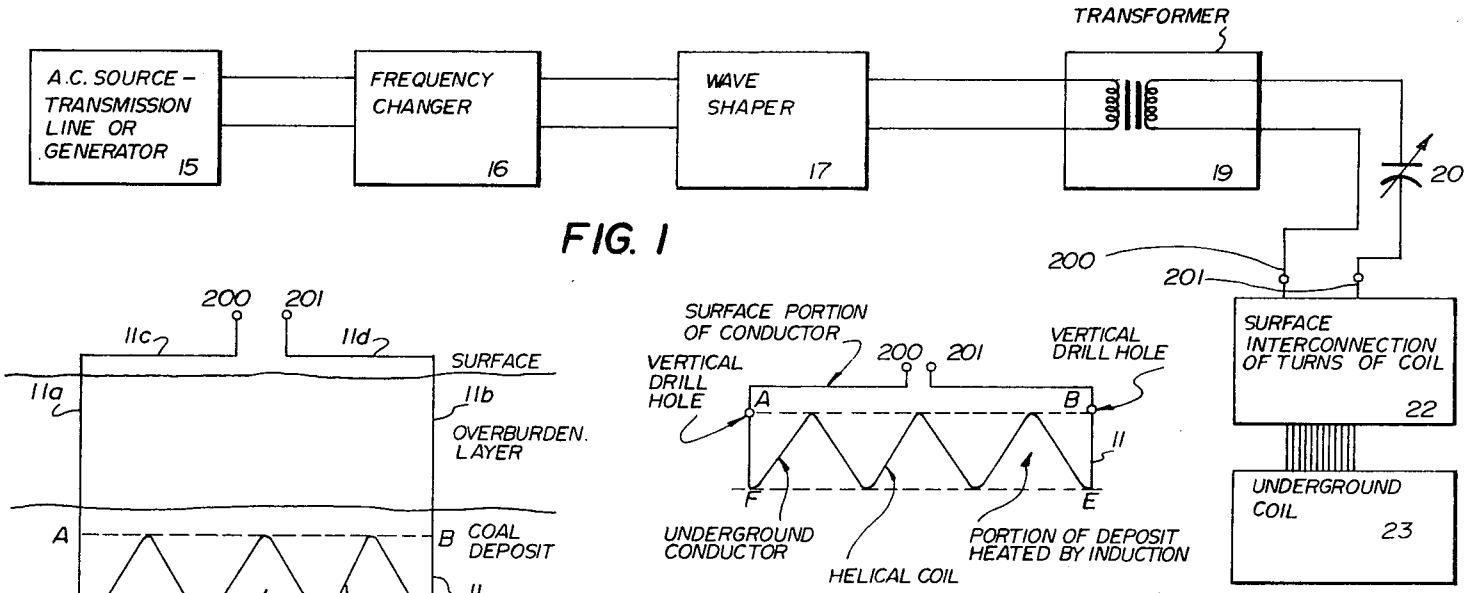
FIG. 1 is a schematic drawing of the electrical circuitry used for the input of the induction heating coil and the control system.
FIG. 2 is a schematic elevation view illustrating a conductive path and associated surface electrical equipment for use in heating by induction of a selected portion of a coal deposit, wherein a helical coil is employed.
FIG. 3 is a schematic plan view of the conductive path and surface connections therefor illustrated in FIG. 1.

FIG. 1 illustrates the surface control system circuitry common to any type of underground coil configuration. Alternating current input 15 from an AC generator or a transmission line drives a frequency changer 16 and wave shaper 17 connected to the primary winding of a transformer 19. Transformer 19 is a step down transformer intended to supply a relatively low voltage high amperage current to the underground coil configuration and is ordinarily located close to the surface interconnection unit 22 of turns of the coil.

A capacitor 20 is connected to the surface interconnection unit 22 and hence to the underground induction coil (which, because of its shape, has appreciable inductance) in order to resonate the underground coil at the frequency selected for operation. In series resonant circuit the positive reactance of the coil is numerically equal to the negative reactance of the capacitor 20, and the combined impedance is purely resistive, equal to the ohmic resistance of the coil plus the resistance reflected into it from the resistivity to eddy currents of the portion of the coal deposit encompassed by the induction heating coil. The resonating capacitor 20 is employed only when the current wave form applied to the coil is sinusoidal or near sinusoidal. When a square or nearly square wave form is employed, no resonating capacitor 20 is employed, and the positive reactance of the induction heating coil remains uncancelled.

It is expected that with experimental testing, the inductive heating effects in the coal deposit will be found to be dependent upon the frequency of alternating current passed through the underground coil, and also upon the shape of the wave form of the current (and indeed may vary with the temperature and other parameters as the underground mass is heated). For this reason, the frequency changer 16 and wave shaper unit 17 are shown in order that alternating current of the desired frequency and wave shape be supplied to the underground coil. If, however, experimentation reveals that the frequency and wave shape of the current supplied by the high voltage alternating current generator or transmission line 15 is satisfactory, the frequency changer 16 and wave shaper unit 17 could be omitted and the generator or transmission line 15 connected directly to the transformer 19. (In North America it would ordinarily be expected that the AC generator or transmission line 17 would carry current having a frequency of 60 Hz and a sinusoidal wave form).

The surface interconnection of unit 22 for the turns of the coil is further illustrated by FIG. 8 and is applicable usually to the quasi-toroidal coil hereinafter discussed. Connections 200 and 201 represent the junction between the interconnected turns of the induction coil and the secondary of transformer 19 and capacitor 20. For the case of the helical induction coil (FIGS. 2–6), the interconnections are not usually made because all turns of the coil are normally in series. However, parallel or series parallel connections of the turns of the helical coil could be made in the manner described in FIG. 8 for the quasi-toroid. FIGS. 2, 3, 4 and 5 illustrate a helical coil with series connected turns so that the surface interconnection unit 22 of FIG. 1 is not employed. The helical coil of FIG. 6 does employ surface interconnection unit 22.

In FIG. 1, the number of connections between surface interconnection unit 22 and the underground coil 23 depends on the manner of connections and on the number of turns of the coil. Arbitrarily, 12 connections corresponding to twelve turns of a coil have been shown. The exact number depends on the operating structure and parameters for the particular case.

In FIG. 2, a coal deposit is shown located between an overburden layer and a rock floor. Within the coal deposit, an electrical conductor 11 forms a generally helical path substantially encompassing the volume ABCD within the said deposit. (In the plan view of the same region illustrated schematically in FIG. 3, the same volume is identified by the letters ABEF.) At each end of the helix, the conductor 11 extends vertically upwards to the surface of the ground along paths 11a, 11b respectively which, when they can reach the surface, extend along surface conductors **11*c*, 11*d* respectively to the control system circuitry of FIG. 1, at 200, 201.**

A cylindrical helical coil configuration is frequently found in industrial induction heating apparatus because the electromagnetic field is strongest within such helix and decreases in intensity outside the coil. Thus if the material located within the volume encompassed by the helix is relatively uniform, the induction heating energy can be expected to be transferred to substantially all the material encompassed by the coil. The above is true also of a toroidal coil, and the toroid avoids the end losses associated with a helix. If the economics of the situation warrant it, a toroid (or simulated toroid) could be used instead of a helix. The rate of absorption of energy from the helical conductive path increases with the intensity of the electromagnetic field generated, and also increases with the conductivity of the energy absorbing material located within the helix. The rate of absorption of energy also increases with increasing frequency, within certain limits. Because of resonance effects, there may also be an optimum frequency for energy absorption of any given condition, which optimum frequency may conceivably vary over the duration of the heating and extraction processes.

Figure 5:
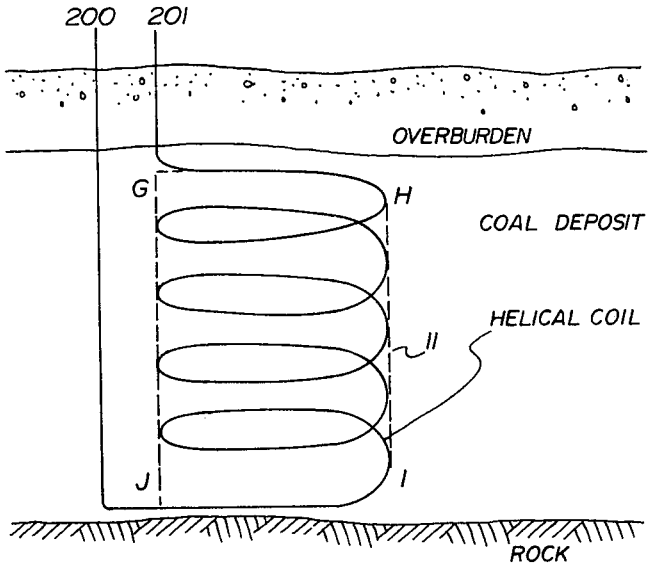
FIGS. 5 and 6 are schematic perspective views of alternative underground conductive paths for the induction heating of a selected portion of a coal deposit in accordance with the principles of the present invention.

A helix oriented in a direction perpendicular to the orientation of the helix of FIGS. 2 and 3 might perhaps be more easily formed than that of FIGS. 2 and 3. FIG. 5 illustrates such a helical path substantially encompassing and intended to heat by induction the volume GHIJ.

Figure 4:
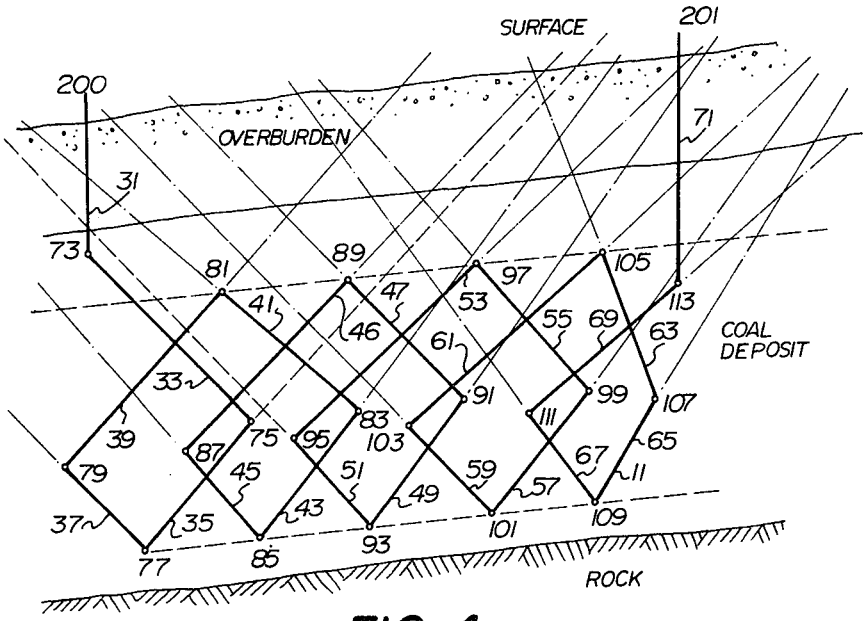
FIG. 4 is a schematic view illustrating a pattern of straight line drill holes so located as to enable the simulation of the conductive path of FIG. 2.

In any event, the helix of FIGS. 2 and 3 may be simulated by a number of interconnected straight line conductive paths which can be formed in the manner illustrated by FIG. 4. The conductive paths of FIG. 4 are formed in interconnected straight line drill holes. Vertical drill holes 31 and 71 are formed. Drill holes 33, 35, 37, 39, 41, 43, 45, 46, 47, 49, 51, 53, 55, 57, 59, 61, 63, 65, 67 and 69 are formed at appropriate angles to the surface to enable these drill holes to intersect one another and with holes 31 and 37 at points 73, 75, 77, 79, 81, 83, 85, 89, 91, 93, 95, 97, 99, 101, 103, 105, 107, 109, 111 and 113, thereby forming the simulated helical path commencing at point 73 and ending at point 113. Conductors may be located along the appropriate portions (viz. between points of intersection and between the surface points 73, 113) of the aforementioned drill holes and interconnected at the aforementioned points of intersection so as to form a continuous conductive path beginning with vertical segment 31 and ending with vertical segment 71.

Figure 6:
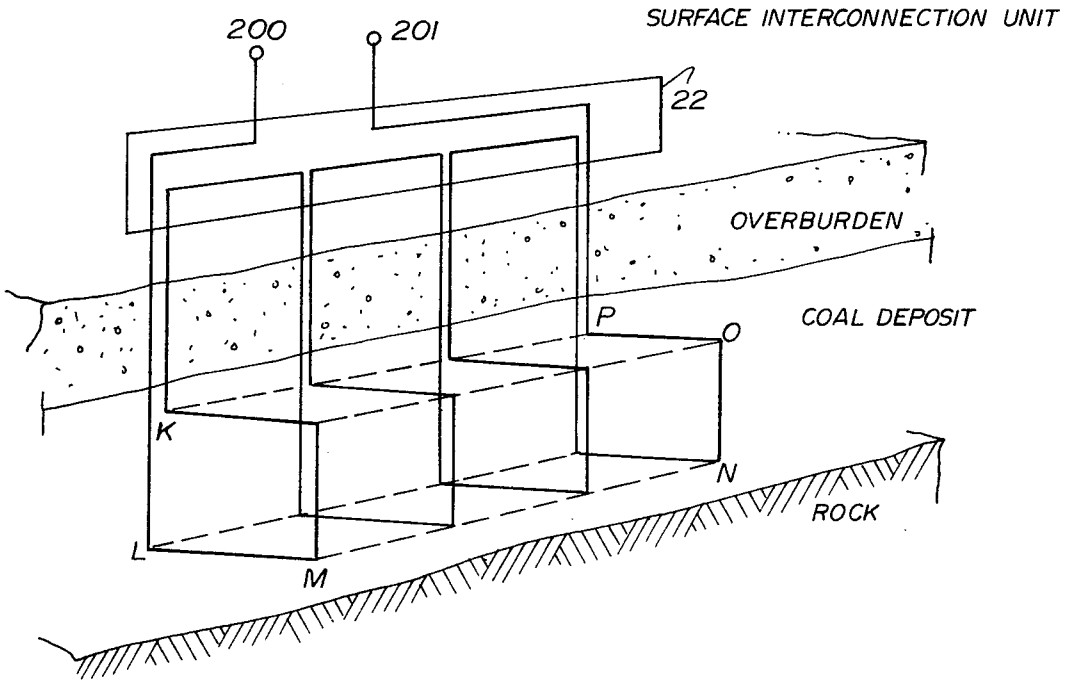

Alternatively a series of generally rectangular conductive loops may be formed, each loop located within a plane, the planes of the loops being parallel to one another, so as to define an encompassed volume KLMNOP, as illustrated schematically in FIG. 6. These rectangular loops of course will remain open at some point, e.g. at a corner, so as to enable current to flow around the loop. The loops are then connected at the surface interconnection 22 in the manner illustrated in FIG. 6 to form a continuous circuit from terminal 200 to terminal 201. Other possible arrangements of interconnected series or parallel connected loops will readily occur to those skilled in the art.

In each of FIGS. 2 through 6, the junctions 200, 201 represent the connection points between the underground induction coil and the circuitry of FIG. 1.

Alternatively, a quasi-toroidal coil configuration may be utilized for the induction heating of an underground coal deposit.

Figure 7:
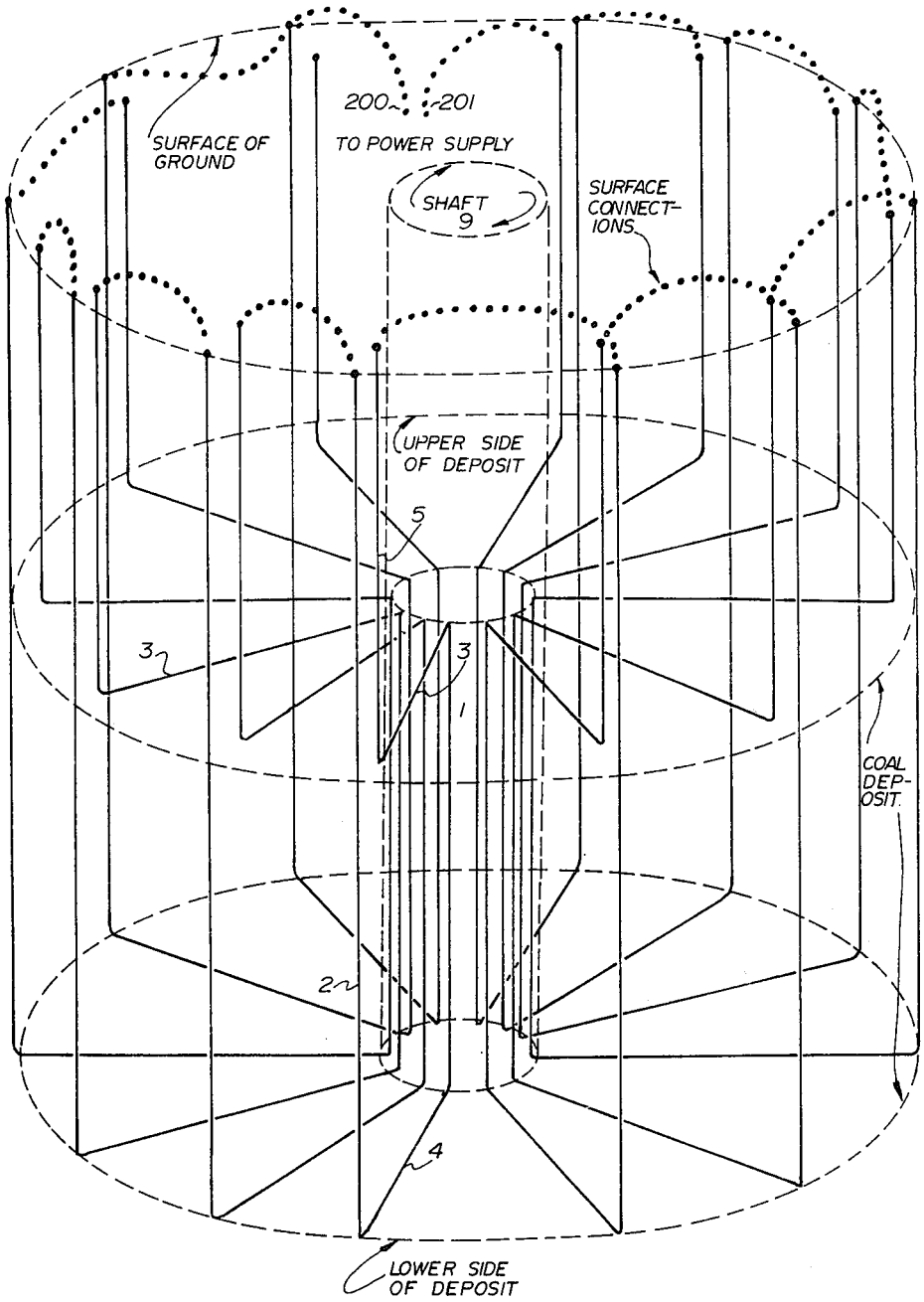
FIG. 7 is a schematic perspective view of a typical conductive path and surface connection wherein a quasi-toroid is employed.

FIG. 7 illustrates schematically an embodiment of an inner quasi-toroidal envelope constructed in accordance with the present invention. Within a coal deposit, inner vertical conductor segments 1 are connected by upper horizontal conductor segments 3 and lower horizontal conductor segments 4 to outer vertical conductor elements 2. Upper horizontal conductor segments 3 are connected to vertical conductor segments 5. In FIG. 7, by way of example, twelve turns are illustrated, each turn being composed of three vertical conductor elements 1, 2 and 5 and two horizontal conductor elements 3 and 4 so as to form a substantially rectangular turn. The turns are arranged at angles of about 30° to one another. It will be noted that the turns do not comprise complete turns. There is a discontinuity present at the outer upper corner of each rectangular turn. This of course is essential in order that current flow around the parallel connected, series connected or series-parallel connected rectangular turns. The term "interrupted turn" is sometimes used herein to indicate as such a discontinuity is present.

Vertical conductor segments 1 and 5 extend above the surface of the ground where various interconnections hereinafter described and depicted in FIG. 8 may be made in the surface interconnection unit 22 of FIG. 1. The dotted lines of FIG. 7 illustrate the case where the coils are connected in series. The input terminals 200 and 201 of the coil configuration are connected to the control system circuitry of FIG. 1 (not shown in FIG. 7).

When alternating current is applied to terminals 200 and 201, an electromagnetic field is generated by the rectangular coils. The electromagnetic field tends to permeate a quasitoroidal space which differs from true toroidal space not only because of the drop off in field between conductive turns (especially at their outer extremities) but also because of the interrupted rectangular coil configuration in distinction from the usual circle coil configuration which would appear in conventional small scale toroidal inductors. The quasi-toroidal space has an inner radius defined by the radius of the notional circle on which the junction points of conductors 1 with conductors 4 lie. The outer radius of the quasi-toroidal space is defined by the outer vertical conductor element 2. The upper limit of the quasi-toroidal space is defined by a notional horizontal annular surface in which the upper conductor elements 3 lie. A similar notional annular surface in which the lower conductor elements 4 lie defines the lower boundary of the quasi-toroidal space. Thus the turns formed by the inner and outer vertical conductor elements 1, 2 and 5 and the upper and lower horizontal conductor elements 3 and 4 together form a quasi-toroidal envelope which substantially surrounds the quasi-toroidal space defined above. Obviously the more turns that are used in the envelope, the more closely the actual electromagnetic field will extend throughout the entire quasitoroidal space surrounded by the envelope. However, bearing in mind that tunnelling or drilling is required for the introduction of each of the conductor elements into an underground hydrocarbon deposit, a trade off must be made between efficiency of generation of the electromagnetic field within the quasitoroidal space and the economics obtained by minimizing the number of holes or tunnels drilled or excavated. In the discussion which follows it will be assumed that the number of turns of the quasi-toroidal coil is twelve. However, some other number of turns may be utilized in appropriate situations, and empirical evaluation of the effectiveness of the number of coils initially employed will undoubtedly be made in particular applications to determine whether a greater or fewer number of turns may be suitable. Obviously additional tunnels and drill holes can be provided to increase the number of turns as required. Since the detailed design in no way affects the principles herein disclosed, the examples shown in the drawings must not be considered unique.

Figure 8:
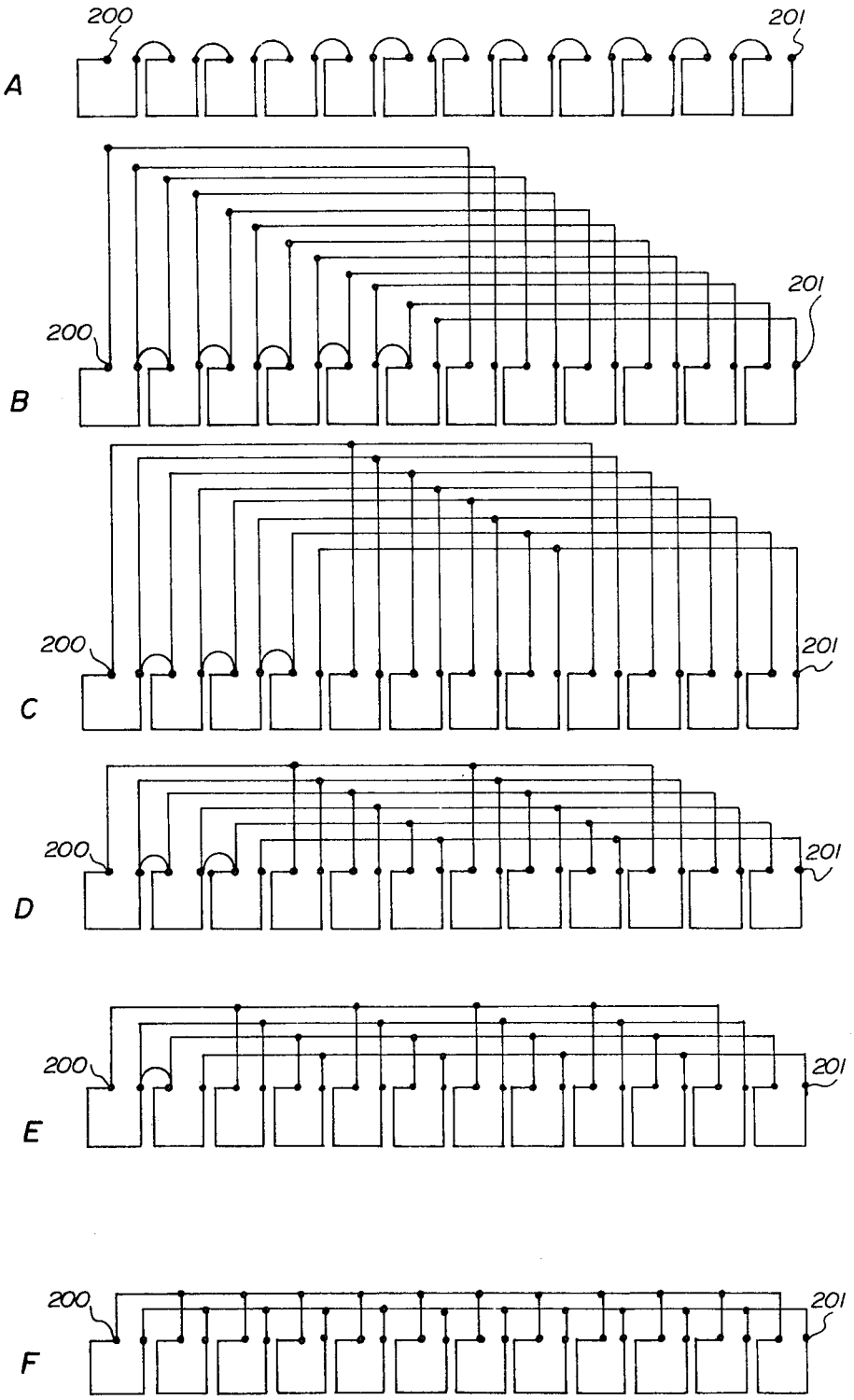
FIG. 8 is a schematic diagram illustrating six optional schematic interconnection arrangements of the conductive paths of FIG. 7.

The surface interconnection unit 22 of turns of the coil of FIG. 1 is elaborated upon in FIG. 8. Numerals 200 and 201 correspond to the input to the surface interconnections 22 of FIG. 1.

FIG. 8 shows in schematic form the twelve turn coil of FIG. 7, with the turns connected in six possible ways. In detail A the twelve turns are connected in series, as in FIG. 7; in detail B six series connections each of two turns in parallel are provided; in detail C, four series connections each of 3 turns in parallel; in detail D, 3 series connections each of 4 turns in parallel; in detail E, 2 series connections each of 6 turns in parallel; and in detail F a single path of twelve turns in parallel. The tabulation below shows that these provide a relative inductance range of 144 to 1, (and therefore a relative resonating capacitance range of 1 to 144) and this wide range permits convenient choices of other circuit parameters in a great variety of coal deposits.

| Turn Connections | Relative Inductance | Relative Max Currents | Relative Resistance |
|---|---|---|---|
| A | 144 | 1 | 144 |
| B | 36 | 2 | 36 |
| C | 16 | 3 | 16 |
| D | 9 | 4 | 9 |
| E | 4 | 6 | 4 |
| F | 1 | 12 | 1 |

Figure 9:
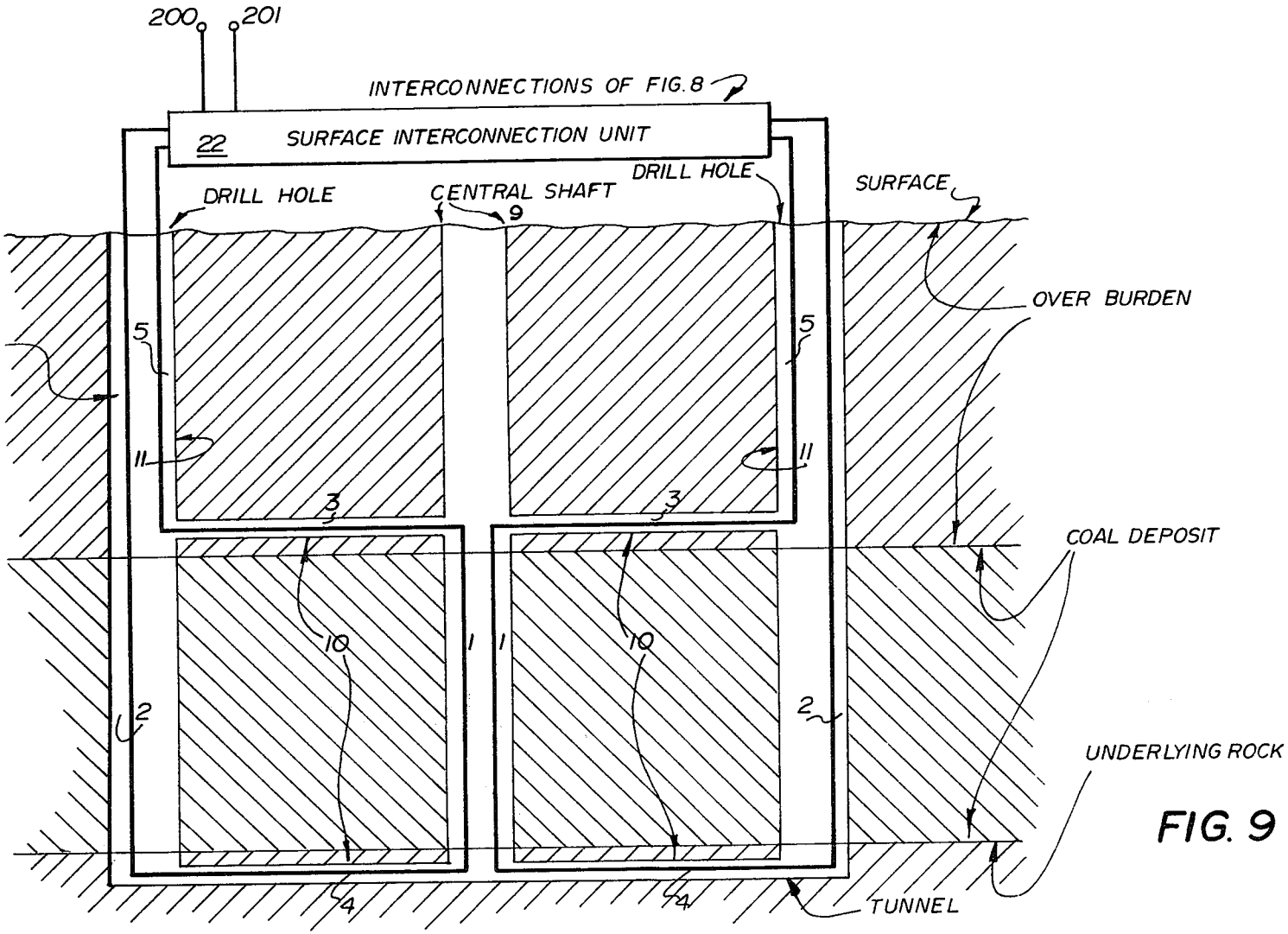
FIG. 9 is a schematic elevation view of two turns of a quasi-toroidal underground coil, with the connections to the surface sited components of the system.

FIG. 9 shows a schematic elevation view of two turns of the coil in FIG. 8 with the central vertical shaft 9, the horizontal tunnels 10, and the vertical drill holes 11 through which the conductors are threaded. The surface interconnection unit 22, drawn from one of the options of FIG. 8, is also shown.

The resistivity of dry coals at 20° C ranges from $10^{10}$ to $10^{14}$ ohm cm. However, the resistivity decreases exponentially with temperature and reaches about 5 ohm cm at 900°. It is useful to take advantage of this property of coal before induction heating is initiated. Referring to FIG. 9, oxygen or other suitable gas or liquid is injected at the inner face of the portion of the deposit to be heated. Here, the central shaft 9 or drill holes 23 at the inner radius of a quasi-toroidal coil would be so injected. Next, the coal along the inner face or drill holes is ignited. This reduces the resistivity of the coal at the inner face. Thus, when induction heating is commenced, by applying current to the turns of the coil large currents will flow more readily, because of the greatly reduced resistivity. The induction heating will then spread outwardly from the inner face or drill holes so ignited and heated. In FIG. 9, the heating would progress outwardly from the shaft 9.

For the reasons previously discussed, there is a practical upper limit on the ratio of the outer radius of the quasi-toroidal envelope defined by the vertical conductors 2 of FIG. 9 to the inner radius of the quasi-toroidal envelope defined by the location of the inner vertical conductor elements 1 of FIG. 9. For this reason it may be desirable to provide a further quasi-toroidal envelope surrounding that illustrated in FIG. 7 or 9. Such further quasi-toroidal envelope could utilize as its innermost vertical conductor elements the conductor elements 2 of FIGS. 7 or 9. Mathematical studies have shown that the ratio of the outer radius of the quasi-toroidal envelope to the inner radius of the quasi-toroidal envelope should not be greater than about 5 or 6 for best results. If this limit is observed, the efficiency of the induction heating process is greatly increased, since the ohmic losses in the coil conductors are kept to a low value, and the energy is principally expended in heating the coal.

Figure 10:
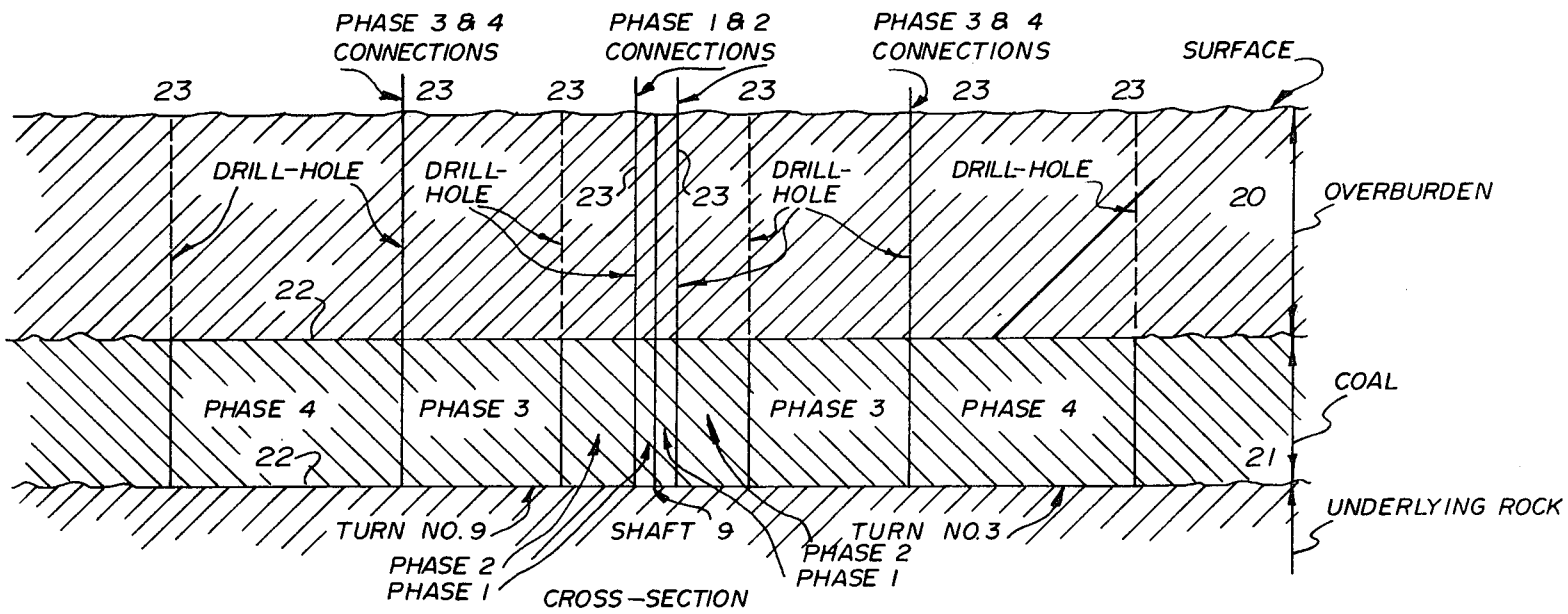
FIG. 10 is a schematic elevation view of a typical quasi-toroidal conductor path where the heating is carried out in four successive stages.

FIG. 10 is a schematic elevation view of the conductor paths which may be used for a four phase coal heating operation. A central shaft 9 of radius about 5 feet is sunk from the surface through the overburden 20, and through the coal deposit 21. Two sets of equally spaced radial horizontal tunnels 22 of say 40 inch diameter are drilled from the central shaft 9. One set of radial horizontal tunnels 22 is located at the upper face of the coal deposit 21. The second set of horizontal tunnels 22 is located at the lower face of the coal deposit 21. Next, four sets of vertical drill holes 23 are sunk from the surface through to the bottom of the coal deposit 21. Each set consists of 12 vertical drill holes 23 equally spaced about the circumference of a circle and located so as to intersect the upper and lower horizontal tunnels 22. Each vertical drill hole has a radius of about 16 inches. The number of sets of vertical drill holes is dependent upon the extent of the coal deposit. For illustrative purposes, four sets have been described here.

Figure 11:
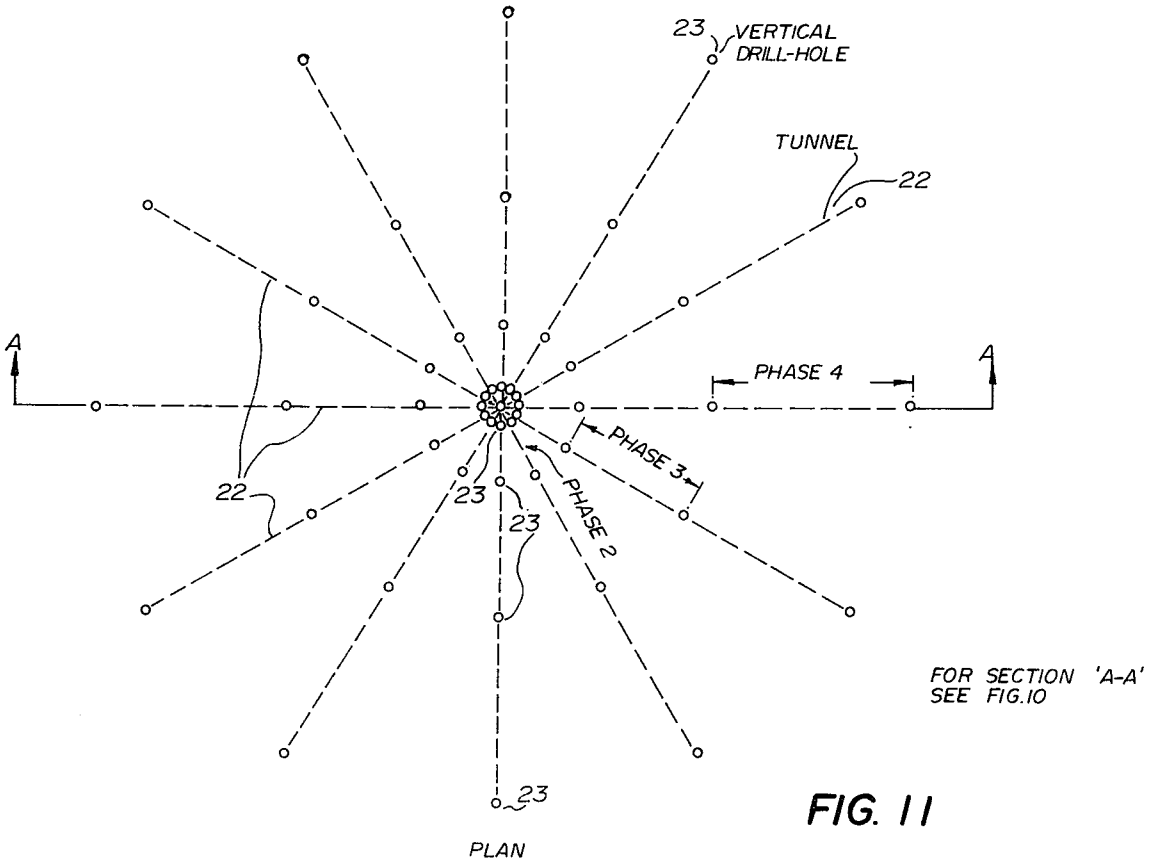
FIG. 11 is a schematic plan view of a typical quasi-toroidal conductor path of FIG. 10, showing the disposition of the conductors underground in the shaft, tunnels, and drill holes, for the heating of the coal deposit.

FIG. 11 is a schematic plan view of the configuration of FIG. 10 illustrating the vertical drill holes 23. Four sets of vertical drill holes 23 are depicted. The inner set of twelve vertical drill holes 23 lies upon the circumference of a circle of radius 20–30 feet. The second set lies on a circle of radius 100–200 feet; the third set on a circle of radius 500–1200 feet and the fourth set on a circle of radius about 2500–7200 feet. The dashed lines of FIG. 11 show the horizontal tunnels 22. There are twelve such tunnels at the upper face of the coal deposit and twelve more at the lower face. Obviously, both sets of tunnels cannot be shown in a plan view.

Figure 12:
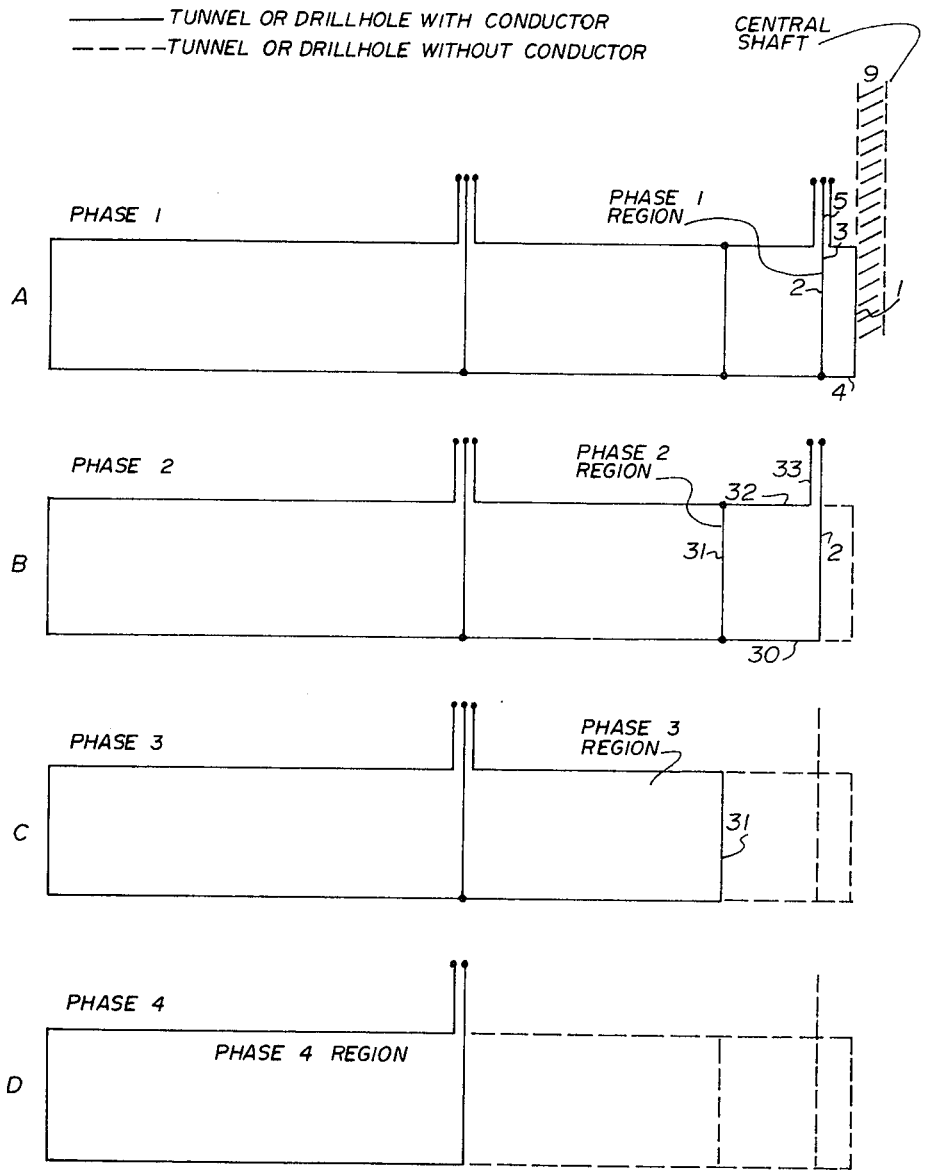
FIG. 12 is a schematic elevation view of the configuration of FIG. 11.

FIG. 12 is a schematic elevation view showing the conductors of one turn of the coil within the vertical drill holes, central shaft and horizontal tunnels. The cross-hatched area 9 depicts the central shaft. The solid lines illustrate a conducting element located within a horizontal tunnel, vertical drill hole or central shaft. A dashed line represents such a tunnel, drill hole or central shaft with no conductor.

With respect to detail A of FIG. 12 a single turn of the coil is shown. It is preferable to install the conductors for all four phases of the coal heating operation before beginning to heat the first phase. In the first phase, represented by detail A, the inner vertical conductor segment 1 is connected to the lower horizontal conductor segment 4. Segment 4 is connected to outer vertical conductor segment 2. Vertical conductor segment 1 is connected to upper horizontal conductor 3 and the latter is connected to vertical conductor segment 5. Conductors 2 and 5 are connected to the surface connection arrangement of FIG. 8. The inner radius of the phase 1 coil is about five feet corresponding to the radius of the vertical central shaft 9. The outer radius of the phase 1 coil is 20–30 feet. Power is applied to the coil to initiate the heating of the coal.

When heating of the coal deposit lying within the conductor elements 5, 3, 1, 4 and 2 has been completed, phase 1 of the coal heating operation is finished and phase 2 shown in detail B of FIG. 12 may be begun. In detail B of FIG. 12 conductor elements 2, 30, 31, 32 and 33 are connected so as to form one turn of the electrical induction coil. The phase 2 coil has an inner radius of 20–30 feet and an outer radius of 150–200 feet. Note that conductor element 2 is used for both phase 1 and phase 2.

In a similar fashion, the necessary changes being made, phase 3 and 4 follow phases 1 and 2. Detail C and detail D of FIG. 12 illustrate the interconnection of the conductors for phases 3 and 4. As each phase is completed, the conductors unused in the preceding stage may if desired be disconnected and withdrawn for use elsewhere. It will be noted that the coil connections are brought out at each second drill hole along the radius shown in FIG. 12. The changing of connections between successive phases is therefore facilitated. The arrangement of the installation in a concentric configuration has two important advantages: it permits the utilization of the vertical drill holes and coil conductors twice, for the outer conductors of one stage and the inner conductors of the succeeding stage; and heat transmitted outwardly from any phase is utilized in the succeeding phase. It will be noted that no coil connections are made at the upper end of the central shaft 9 of FIG. 11. This is desirable, since this shaft among others is utilized for the eduction of the gas, and other products which result from the heating of coal. If necessary, other vertical drill holes could be sunk to provide paths for the removal of the gases.

Having described the method by which electrical induction heating is used to heat an underground coal deposit to a temperature sufficient to achieve the breakdown of coal into other products, the details of the processing of the coal deposit are now set forth.

Figure 13:
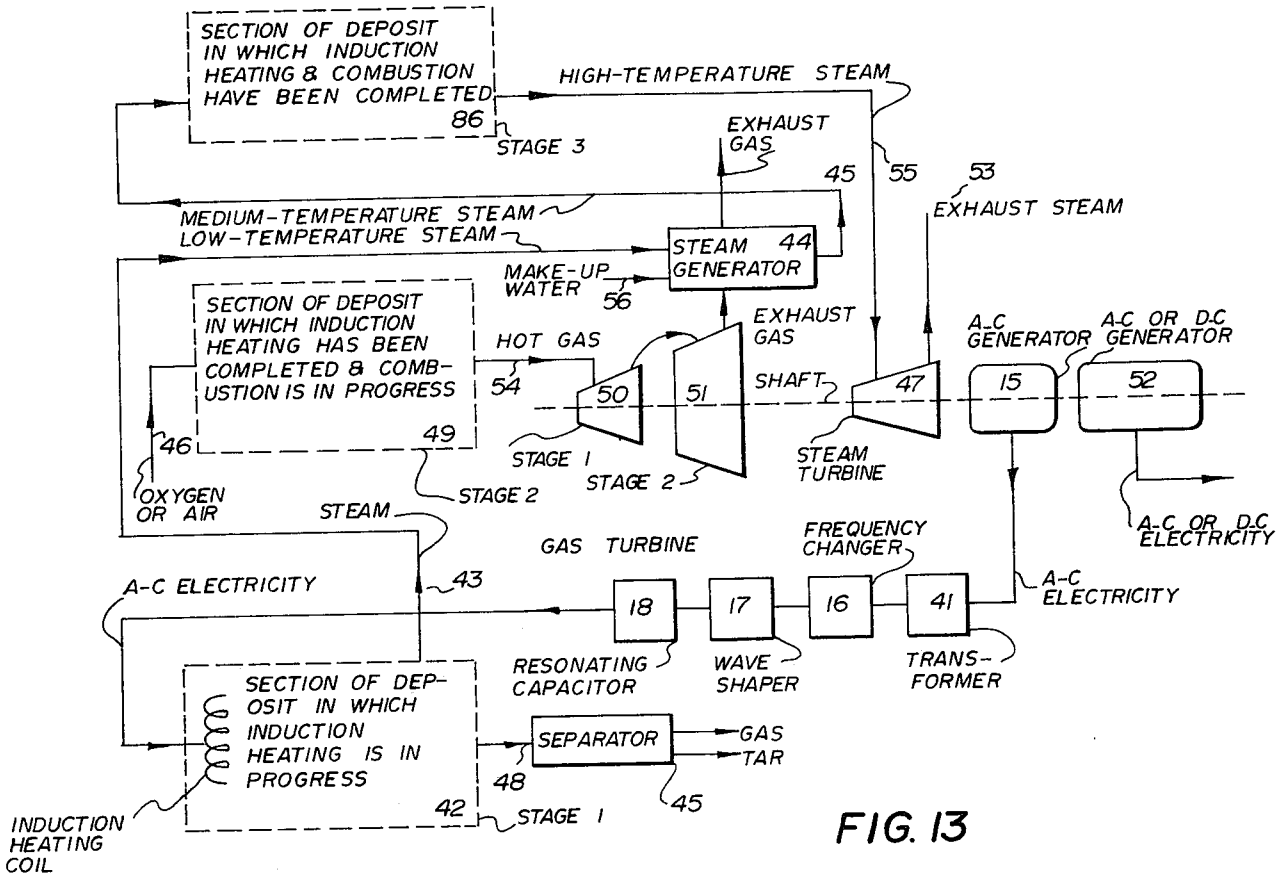
FIG. 13 is a flow diagram depicting all of the steps for extracting gases, liquids and energy from an underground coal deposit.

FIG. 13 shows in schematic form the whole process starting with electrical induction heating of a selected portion of a coal deposit and continuing through several stages to the generation of electricity, part of which is used for the induction heating of a further selected portion of the coal deposit. It is contemplated that the stages described below might, for example, be carried out simultaneously. A section of the deposit wherein heating is completed could undergo combustion while yet another section is being heated by induction and another portion of the deposit, having undergone combustion, has the heat removed by a heat exchange method.

An AC generator 15 which generates alternating current electricity drives the transformer 41 which acts as the input to the frequency changer 16, wave shaper 17 and resonating capacitor 18 which are in series connection. From the resonating capacitor 18, a connection is made with the induction heating coil located in the section of the coal deposit which is to be heated. The heating coil and the section of the coal deposit undergoing induction heating are represented in FIG. 13 by 42.

Induction heating can be applied to semi-conducting materials, among which coal in its various ranks is included. These semi-conducting materials range in resistivity from about $10^{-4}$ Ohm-Cm to at least $10^{6}$ Ohm-Cm and possibly higher. This is in contrast to the electrical resistivities of metals, which range from about $10^{-6}$ Ohm-Cm to $2 \times 10^{-5}$ Ohm-Cm.

In electrical induction heating, the time varying current passing through the induction coil which encompasses the portion of the coal deposit to be heated generates a time varying magnetic field. The lines of force of the magnetic field intersect the coal, and generate electrical currents, usually called eddy currents. These eddy currents, flowing through the coal, heat it by virtue of the coal's resistivity. As the coal is heated its resistivity will vary, first due to the loss of water, then due to the loss of the coal gas and coal tar components, then due to the change in resistivity of the coke residue, with changing temperature, and finally due to the changing radius of the coal face. The current in the coil is therefore adjusted manually or automatically so that the total volt-amperes drawn from the generator 15 is approximately constant.

Coal begins to give off water vapor when heated above 100° C. The water vapor or steam 43 is of low temperature and is led from the coal deposit to the surface of the ground where it is fed into a steam generator 44.

As the temperature of the coal deposit continues to increase, a distinct stage of active decomposition begins to occur at about 400° C. In the range of 400°–500° C, most of the coal tar is produced. This tar is a complex mixture of chemical compounds quite distinct from coal although these compounds are obviously related to the chemical structures in coal. The liquid coal tar fraction is rich in aromatic ring hydrocarbons which may be separated by fractional distillation. These include benzene, toluene, xylene, naphtaline and anthracene.

As the temperature of the underground deposit increases above 500° C the evolution of coal gases commences and the liquid coal tars become gaseous. The volatile gas contains a large amount of ammonia which may be separated from the coal gas by solution in water. After further cleaning and scrubbing to remove sulphur compounds, the coal gas contains largely methane, hydrogen and carbon monoxide, which are all useful fuel gases plus some small amounts of nitrogen. The effect of further heating above 500° C is to convert the coal tar from a liquid to a gaseous form. Studies have shown that the maximum heating temperature for a coal deposit should be about 750° C. Heating beyond 900° C would decompose some of the tar involved at lower temperatures and the yield obtained at these higher temperatures such as 900° C is often less than half that available at about 500° C.

The coal gas and coal tar in gaseous form, 48, is led to the surface of the ground through the central shaft or vertical drill holes. There, a separator 45 removes the ammonia within the coal gas and separates out the gas and coal tar components.

Thus, to summarize, in stage 1 of the extraction process, steam is first generated by heating the coal. The steam 43 is led to the surface of the ground for further use. As the coal deposit increases in temperature, coal gas and coal tar in gaseous form 48 are produced. These rise to the surface where they are collected and separated by means of a separator 43.

When the temperature of the deposit has reached about 500° C or more and the coal gas and coal tar in gaseous form have been evolved, the residue in the deposit is principally coke consisting mainly of carbon, ash, and inclusions of rock. This material may in the case of high volatile bituminous coals have a density of only one third to one half of the original coal, and is therefore porous and gas permeable. The induction coil conductors are withdrawn and air or oxygen 46 is introduced into the heated coke deposit 49 at a controlled rate, by way of one or more of the existing drill holes. Combustion takes place, and the heated combustion products 54, consisting primarily of carbon dioxide, are led to the surface, where they serve to drive the first stage 50 of a gas turbine. The gas turbine may have two or more stages. In FIG. 13 a second stage 51 is illustrated. The exhaust from the gas turbines 50 and 51 is fed to the steam generator 44 which heats the steam 43 evolved from the deposit at the beginning of the stage 1 process.

The combined mechanical output of the gas turbines 50 and 51 may be coupled with the output of the steam turbine 47, to be described later, and employed to drive one or more electrical generators 15 and 52. The output of the AC generator 15 is connected through the transformer 41, frequency changer 16, wave shaper 17, a resonating capacitor 18 as discussed above to the induction heating coil of stage 1, 42.

Once the stage 2 processing of the deposit is completed, 49, stage 3 may be commenced. On completion of stage 2, all of the coke in the deposit has been burned. However, the underground region where the coal deposit was remains very hot because of its thickness and the low value of the thermo-conductivity of the overburden. This heat is retained with negligible loss for long periods, and may be utilized at almost any rate desired. This heat may be extracted by the injection of the low temperature exhaust steam 53 from the steam turbine 47 and the medium temperature steam 45 produced by the steam generator 44 into the section of the deposit in which induction heating and combustion have been completed, 86. This sequence of events constitute stage 3 of the process. It is likely that the steam 43 originally derived from the coal deposit in stage 1 will be sufficient usually to carry out the whole process, but in the event that it is not make up water 56 can be added to the steam generator 44. The medium temperature steam 45 injected into the hot underground deposit is heated and emerges to the surface as high temperature steam 55. The high temperature steam 55 drives the steam turbine 47.

By way of conclusion the extraction process described herein consists of three stages. In stage 1, the coal deposit is heated by electrical induction heating in order to generate steam, coal gas and coal tar in gaseous form. Following the extraction of the steam, coal gas and coal tar in gaseous form, stage 1 of the process depicted in FIG. 12 is completed.

The underground deposit consists primarily of heated coke once the gases have been educted to the surface. Air or oxygen is injected into the hot coke deposit after the conductor segments have been removed and combustion ensues. The combustion product is a hot gas, carbon dioxide, which is led to the surface to drive gas turbines. The completion of the burning of the coke marks the finish of stage 2 of the processing.

In stage 3, the heat generated by the coke combustion is extracted by injecting medium temperature steam into the heated underground deposit. The steam is converted to high temperature steam which may then be used to drive a steam turbine.

As indicated above, stage 1, 2 and 3 processing is, obviously carried out sequentially for any specific region of the coal deposit. However, the processing may be performed simultaneously if several different regions of the deposit are considered. A portion of the deposit in which stage 1 processing is completed may undergo stage 2 of the process at the same time as another portion is in stage 1 processing.

Figure 14:
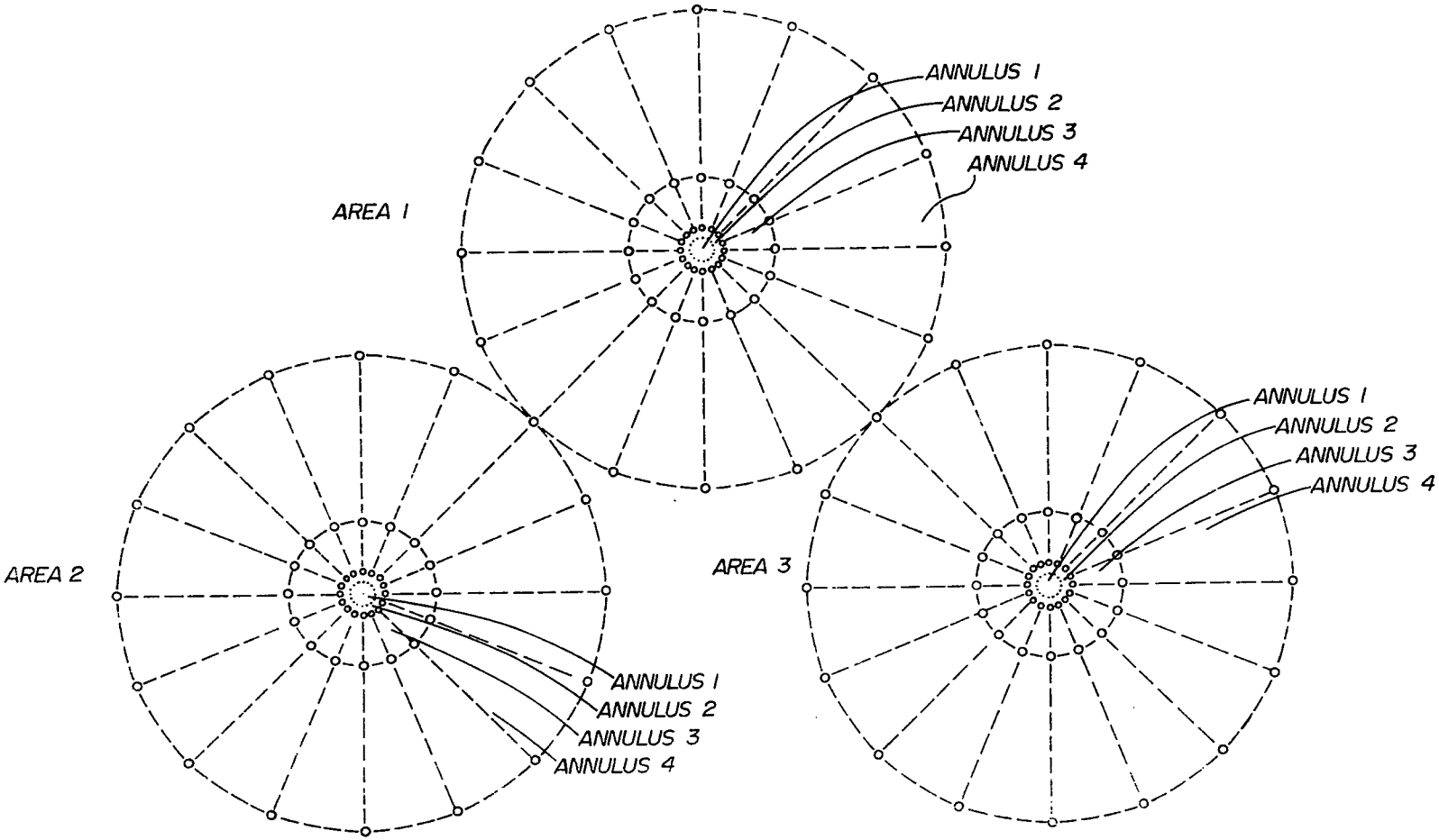
FIG. 14 schematically illustrates a preferred technique for induction heating of a large area of a coal deposit.

FIG. 14 illustrates an alternative method of operation which involves the placing of concentric induction coils in three neighbouring areas. These might be circular areas and abut upon one another. A possible sequence of operations for say the first four annuli in this case might then be as follows:

| PERIOD | AREA | ANNULUS | INDUCTION HEAT | BURN COKE | STEAM FLOOD |
|---|---|---|---|---|---|
| 1 | 1 | 1 | x | — | — |
| 2 | 1 | 1 | — | x | — |
| 3 | 1 | 1 | — | — | x |
| 2 | 2 | 1 | x | — | — |
| 3 | 2 | 1 | — | x | — |
| 4 | 2 | 1 | — | — | x |
| 3 | 3 | 1 | x | — | — |
| 4 | 3 | 1 | — | x | — |
| 5 | 3 | 1 | — | — | x |
| 4 | 1 | 2 | x | — | — |
| 5 | 1 | 2 | — | x | — |
| 6 | 1 | 2 | — | — | x |
| 5 | 2 | 2 | x | — | — |
| 6 | 2 | 2 | — | x | — |
| 7 | 2 | 2 | — | — | x |
| 8 | 3 | 2 | x | — | — |
| 9 | 3 | 2 | — | x | — |
| 10 | 3 | 2 | — | — | x |
| 9 | 1 | 3 | x | — | — |
| 10 | 1 | 3 | — | x | — |
| 11 | 1 | 3 | — | — | x |
| 10 | 2 | 3 | x | — | — |
| 11 | 2 | 3 | — | x | — |
| 12 | 2 | 3 | — | — | x |
| 11 | 3 | 3 | x | — | — |
| 12 | 3 | 3 | — | x | — |
| 13 | 3 | 3 | — | — | x |
| 12 | 1 | 4 | x | — | — |
| 13 | 1 | 4 | — | x | — |
| 14 | 1 | 4 | — | — | x |
| 13 | 2 | 4 | x | — | — |
| 14 | 2 | 4 | — | x | — |
| 15 | 2 | 4 | — | — | x |
| 14 | 3 | 4 | x | — | — |
| 15 | 3 | 4 | — | x | — |
| 16 | 3 | 4 | — | — | x |

In FIG. 14, successive ratios of the radii of the four concentric annuli 1, 2, 3 and 4 of area 1, area 2 and area 3 are roughly five or six to one. The three areas, area 1, area 2 and area 3, are made to encompass about the same amount of fuel, so that the production of the heating operation is about constant at all times. Refer to FIGS. 10, 11 and 12 for details of the set of concentric coils placed within each of area 1, area 2 and area 3. The small circles of FIG. 14 represent the vertical drill holes sunk from the surface. The straight lines show the underground horizontal tunnels.

Other procedures are possible, but appear to be less advantageous than that outlined above. This plan is for a total of three adjacent areas, each of which is divided into say four concentric annuli. Three separate areas of the deposit are blocked out, and initially annulus 1 area 1, annulus 1 area 2 and annulus 1 area 3 are worked, with the sequence changing as given in the table on page 23 as each process is completed in each annulus.

To heat the coal by electrical induction an electrical input to the underground toroidal coil encompassing the seam or seams of possibly 400 MW is required.

Coal and lignite are classed as intrinsic semi-conductors, as are the other fossil fuels-oil-sand, oil-shale, petroleum, etc., and have the electrical conductivity (or resistivity) variations characteristic of this class of materials. The specific electrical resistivity of all dry coals is extremely high at 20° C in the range of $10^{10}$ to $10^{14}$ ohm cm, with the anthracites near the upper limit and the lignites near the lower limit. The resistivity decreases exponentially with the absolute temperature, and for all coals reaches a value of the order of 5 ohm cm at about 900° C temperature. In order to heat coal effectively by electrical induction may be necessary to take advantage of this great reduction in resistivity at an elevated temperature. Before the electrical induction heating cycle is begun, therefore, and after the electrical conductors are in place, oxygen or other suitable material is injected through drill holes or at the central shaft at the inner face of the annulus which is to be processed, and the coal in these drill holes is ignited. The ensuing combustion quickly raises the temperature of a thin layer of coal at each drill hole, and reduces its resistivity to a low value. As soon as this has been accomplished, the oxygen supply is discontinued, and the electrical current started. The magnetic field induces eddy currents mainly in the high-temperature low-resistivity area surrounding each drill hole or at the central shaft, and the induction heating spreads from these focus points, to form a continuous cylindrical shell. The inner coal face of annulus 1 area 1 is fired by admitting oxygen or air and is then ignited, to raise the temperature of a thin layer of the face to about 600° C. At this temperature, resistivity is reduced to a few ohm cm., and large eddy currents flow under the effect of the intense alternating magnetic field generated by the current in the induction coil. Thus, a coil face is rapidly heated; the gaseous products are driven off and the high temperature cylindrical face is rapidly enlarged in diameter leaving only a porous and fractured coke of about half the weight of the original coal, and any ash or mineral matter in place. The inner coal face of annulus 1 area 1 which is initially fired is also represented by the shaft 9 shown in FIG. 7, FIG. 9, FIG. 10 and FIG. 12.

The moisture content, which in typical coals is 20% by weight or more, is the first product of the heating process. This is followed by gas, principally methane, and components of coal tar, in gaseous form.

Typical amounts of production may be in the order of 8,880 tons per day of steam and perhaps 14,000 tons per day of gaseous products. The 14,000 tons per day of gaseous products would, likely, sub-divide into roughly 3,000 tons per day of methane and 11,000 tons per day of gaseous coal tar. These latter products are further processed at the site or piped to market, where they produce sufficient revenue so that the principal product of this installation, electricity, can be considered to be obtained without cost. The water produced from the coal seam will suffice for the process, without drawing on surface water, and is fully utilized when discharged, as discussed later herein. In the event, that the seam being heated includes an underground aquifer, this is located and led to the surface by drill-holes. It may be then used as process water, but in any case is utilized to an environmental advantage.

When annulus 1 of area 1 has undergone induction heating to the point where all steam and gaseous products have been brought to the surface, the electrical connections are changed over to annulus 1 of area 2, and induction heating is commenced there. This then proceeds as described above. Air is next admitted to annulus 1 of area 1, and combustion of the residual coke there takes place at the rate desired. This produces, primarily, an outflow to the surface of hot gases, consisting mainly of carbon dioxide and nitrogen. These are used to drive a gas turbine, operating in conjunction with a steam turbine and an electric generator. The exhaust gas from the gas turbine is used to heat the low-temperature steam derived from the induction heating of annulus 1 of area 1. This has been previously described in FIG. 13 herein.

When combustion is completed in annulus 1 of area 2, the surface electrical connections are changed to heat the coal of annulus 1 area 3 by electrical induction. The medium-temperature steam derived from the steam generator is injected into annulus 1 of area 2, which now consists of a highly-heated cavity containing ash and other organic material. The steam is heated to a high temperature within the underground deposit and then led to the surface where it is fed to a steam turbine which is coupled to the gas turbine and the electrical generator. The turbine exhaust steam is condensed, and the hot water conducted to land under cultivation, where it serves both to irrigate and heat the land. By way of example, the exhaust water may amount to about 6.5 acre-feet per day. This is sufficient in dry northerly climates such as northern Alberta to raise bumper cereal crops annually on about 1200 to 1800 acres, or to provide a considerably larger area of first-class park or recreation land.

In this operation, the combined-cycle gas and steam turbines will generate roughly 2000 MW continuously. Of this power, roughly 400 MW is required for the induction heating process and about 100 MW for operation of the plant and community services. Thus, 1500 MW is made available for transmission.

As mentioned previously, the marketable coal tar and gas produced in this installation will pay the entire operating cost, and the 1500 MW of electricity may be considered to be cost free. No water is drawn from surface streams and a large agricultural or botanical project is made possible by the use of water mined with the coal and raised to the required temperature by what would otherwise be waste heat. Both the water and the heat it contains are in this process utilized beneficently and profitably.

In the foregoing discussion of FIG. 14, reference has not been made to the numerals shown in FIG. 13 which depict the various stages of the process. These were omitted because all of the component parts of the invention had been previously described thoroughly in FIG. 13. The foregoing description of the heating of three adjacent areas simultaneously represents an application of the method described in FIG. 13.

Variants of the above described processes will readily occur to those skilled in the art. This invention is to be construed not as limited by the above specific examples; its scope is as defined in the appended claims.

We claim:

1. A method of processing of an underground coal deposit in situ for the extraction of matter or energy therefrom comprising:

a. substantially encompassing a selected portion of said underground coal deposit with electrical conductor segments;

b. heating by electrical induction said selected portion of the deposit to a temperature sufficient to generate economically recoverable matter or energy; and c. conveying said matter or energy to the surface of the ground.

2. A method as defined in claim 1 wherein the economically recoverable matter comprises steam which is conveyed to and collected at the surface.

3. A method as defined in claim 1 wherein the economically recoverable matter comprises coal gas which is conveyed to and collected at the surface.

4. A method as defined in claim 1 wherein the economically recoverable matter comprises of coal tar in gaseous form which is conveyed to and collected at the surface.

5. A method as defined in claim 1 wherein:

d. the economically recoverable matter comprises coal tar in gaseous form and coal gas, e. said gases are collected at the surface, and f. said gases at the surface are separated from one another to a selected degree of separation.

6. A method as defined in claim 1, wherein the induction heating is continued for a time sufficient to convert at least a portion of the coal deposit into a coke residue comprising the additional steps:

d. injecting a combusting agent into said coke residue to burn at least a portion of said coke residue, e. educting the gaseous products of combustion to the surface; and f. generating mechanical energy from the flow of the gaseous products of combustion.

7. A method as defined in claim 6 wherein the electrical conductor segments are removed from the coke residue prior to carrying out the said steps (d), (e) and (f).

8. A method as defined in claim 6, comprising the additional steps following the generation of mechanical energy from the gaseous products of combustion, of g. injecting steam into the underground region wherein combustion has occurred;

h. educting the heated steam from the said underground region; and i. generating mechanical energy from the flow of heated steam.

9. A method of processing as defined in claim 8 additionally comprising simultaneously processing a second selected portion of the coal deposit by:

a. substantially encompassing said second selected portion of the underground coal deposit with electrical conductor segments;

b. heating by electrical induction said second selected portion of the deposit to a temperature sufficient to generate economically recoverable matter or energy; and c. conveying said last mentioned matter or energy to the surface of the ground.

10. A method as defined in claim 9 additionally comprising simultaneously processing a third selected portion of the coal deposit by:

a. substantially encompassing said third selected portion of said underground coal deposit with electrical conductor segments;

b. heating by electrical induction said third selected portion of the deposit to a temperature sufficient to generate economically recoverable matter or energy;

c. conveying said matter or energy to the surface of the ground for collection;

d. continuing said electrical induction heating for a time sufficient to convert at least part of the said third selected portion of the coal deposit into a coke residue and injecting a combusting agent into said last mentioned coke residue to burn at least a portion of said last mentioned coke residue;

e. educting the gaseous products of said last mentioned combustion to the surface, and f. generating mechanical energy from the flow of the gaseous products of said last mentioned combustion.

11. A method as defined in claim 6, comprising the additional steps following the generation of mechanical energy from the gaseous products of combustion of:

a. injecting water into the underground region wherein combustion has occurred so as to generate steam;

b. educting the steam from said underground region, and;

c. generating mechanical energy from the flow of steam.

12. A method as defined in claim 1 wherein a combusting agent is injected into the portions of the coal deposit adjacent the conductors of said conductor arrangement and said portions are ignited to reduce the resistivity of uncombusted portions adjacent thereto before electrical induction heating is commenced.

* * * * *